US007736213B2

(12) United States Patent
Willinger et al.

(10) Patent No.: US 7,736,213 B2
(45) **Date of Patent: *Jun. 15, 2010**

(54) MOUNTING ARRANGEMENT FOR SQUEAKERS

(75) Inventors: Jonathan Willinger, Tenafly, NJ (US); Klaus Woltmann, Demarest, NJ (US); Ryan Rutherford, Rutherford, NJ (US)

(73) Assignee: J.W. Pet Company, Inc., Teterboro, NJ (US)

( * ) Notice: Subject to any disclaimer, the term of this patent is extended or adjusted under 35 U.S.C. 154(b) by 231 days.

This patent is subject to a terminal disclaimer.

(21) Appl. No.: 11/312,244

(22) Filed: Dec. 20, 2005

(65) Prior Publication Data

US 2006/0121822 A1 Jun. 8, 2006

Related U.S. Application Data

(63) Continuation-in-part of application No. 10/889,962, filed on Jul. 13, 2004, now Pat. No. 7,066,779.

(51) Int. Cl.
*A63H 3/28* (2006.01)

(52) U.S. Cl. ..... 446/184; 119/707

(58) Field of Classification Search ..... 446/183, 446/184, 188; 119/707, 709, 711
See application file for complete search history.

(56) References Cited

U.S. PATENT DOCUMENTS

| | | | |
|---|---|---|---|
| 754,148 | A | 3/1904 | Kuhlemann |
| 1,187,838 | A | 6/1916 | Hughes |
| 1,612,651 | A | 12/1926 | Thomas |
| 1,668,785 | A | 5/1928 | Smart |
| 2,631,407 | A | 3/1953 | Rempel |
| 2,712,201 | A | 7/1955 | Wintriss |
| 2,714,275 | A | 8/1955 | Proll |
| 2,734,309 | A | 2/1956 | Seaver |
| 2,745,214 | A | 5/1956 | Lawson |
| 2,763,960 | A | 9/1956 | Wintriss |
| 2,777,252 | A | 1/1957 | Tancredi et al. |
| 2,817,116 | A | 12/1957 | Miller et al. |
| 2,975,550 | A | 3/1961 | Miller |
| 3,075,317 | A | 1/1963 | Craft |
| 3,702,038 | A | 11/1972 | Hakim |
| 3,956,850 | A | 5/1976 | Seidenberg |
| RE29,050 | E | 11/1976 | Hakim |
| 4,253,254 | A | 3/1981 | Gill |
| 4,380,134 | A | 4/1983 | Taluba et al. |
| 4,506,468 | A | 3/1985 | Willhite |
| 4,779,344 | A | 10/1988 | Panisch |
| 5,113,784 | A | 5/1992 | Forselius |
| 5,267,885 | A | 12/1993 | Niskern et al. |
| 6,112,703 | A | 9/2000 | Handelsman |

(Continued)

*Primary Examiner*—John Ricci
(74) *Attorney, Agent, or Firm*—Katten Muchin Rosenman LLP

(57) ABSTRACT

A method of mounting a squeaker into a hard rubber ball toy. A separate sleeve or shroud is provided that retains a squeaker and forms the noise producing element to be inserted into the rubber toy. The sleeve has a recessed area that tightly mates with an opening in the rubber toy and also includes a bonding surface to secure the sleeve to the toy. The shroud could also be formed with differently sized flanges that extend from a proximate end of the sleeve. An inherent feature of the disclosed structure is that the flanges will cause the noise producing element to be retained within the toy even if the bonding of the shroud to the opening in the toy happens to fail.

20 Claims, 8 Drawing Sheets

U.S. PATENT DOCUMENTS

| | | | | |
|---|---|---|---|---|
| 6,216,640 | B1 | 4/2001 | Zelinger | |
| 6,413,139 | B1 | 7/2002 | Douglas | |
| 6,609,944 | B1 | 8/2003 | Viola | |
| 6,881,120 | B1 | 4/2005 | Janes | |
| 6,935,274 | B1 | 8/2005 | Rothschild | |
| 7,066,779 | B2 * | 6/2006 | Willinger | 446/188 |
| 7,201,117 | B2 | 4/2007 | Ritchey | |
| 7,343,878 | B2 | 3/2008 | Ritchey | |
| 2001/0008125 | A1 | 7/2001 | Mann | |
| 2002/0102912 | A1 | 8/2002 | Duval | |
| 2007/0245976 | A1 | 10/2007 | Ritchey | |

* cited by examiner

MOUNTING ARRANGEMENT FOR SQUEAKERS

RELATED APPLICATIONS

The present application is a continuation-in-part of and claims priority to U.S. Ser. No. 10/889,962 filed on Jul. 13, 2004 now U.S. Pat. No. 7,066,779, which is hereby incorporated in its entirety for all purposes.

BACKGROUND OF THE INVENTION

1. Field of Invention

The present invention relates generally to the field of toys. More specifically, the present invention is related to a toy including a squeaker and method of mounting the squeaker into the toy.

2. Discussion of Prior Art

Generally, inserting a noise producing element into a Figure or ball toy is well known. U.S. Pat. Nos. 754,148, 1,187,838, 1,668,785, RE29050, 3,075,317 and 3,702,038 show such devices.

As far as mounting arrangements go, in the case of vinyl material, as shown in FIG. 1*a* and FIG. 1*b*, the mounting of the squeaker mechanism into a toy is commonly done by molding an opening into the material. A common fitting is inserted into this opening. When bonded this fitting creates a slight whistling sound which could stand alone as a noise element. A barbed squeaker can then be forced into the fitting for a true squeak sound. And for latex material, as shown in FIG. 1*c*, a ribbed mound of material is created with a rough through-hole into which a barbed squeaker is inserted.

The prior art fails to provide squeakers utilizing a separate holder for gluing to a rubber toy. Also, none of the prior art squeakers have the present invention method for complying with child safety standards.

Whatever the precise merits, features, and advantages of the above cited references, none of them achieves or fulfills the purposes of the present invention.

SUMMARY OF THE INVENTION

The present invention includes a mounting arrangement for a squeaker into a rubber ball toy. The squeaker mechanism is trapped within a polystyrene or rubber sleeve to form a noise producing element. The sleeve has a recessed area that tightly mates with an opening in the rubber toy and also includes a bonding surface to secure the sleeve to the toy.

In an alternative embodiment, the sleeve also has fin members that extend orthogonally from a distal end of the sleeve. The total width of the sleeve and the associated fin members is such that it complies with consumer product safety requirements. The fin members make the sleeve substantially larger than the opening in the toy such that it is inherent in the structure that the sleeve and squeaker will fall into the toy if the bond holding the sleeve to the toy happens to fail.

In yet another alternative embodiment, a shroud for enclosing a squeaker has a generally cylindrical but tapered shape and includes two flanges (e.g., an interior flange and an exterior flange) at a proximate end of the shroud. A bonding surface between the two flanges is adapted to fit into an opening in a hollow toy. The interior flange has a diameter that is larger than both the exterior flange and the diameter of the opening in the toy. The structure is thus adapted to retain the shroud enclosing the squeaker within the hollow toy even if the shroud becomes loose from the opening in the toy.

DESCRIPTION OF THE PREFERRED EMBODIMENTS

Figure 1A:
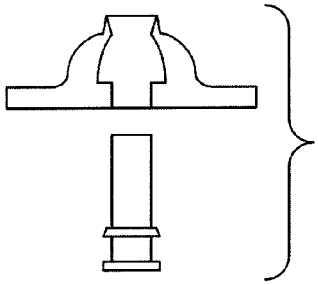
FIG. 1A PRIOR ART
FIG. 1*a* illustrates a prior art common fitting inserted into an opening molded into the vinyl.
Figure 1B:
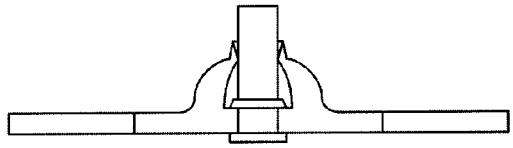
FIG. 1B PRIOR ART
FIG. 1*b* illustrates a prior art method of inserting squeaker into a common fitting.
Figure 1C:
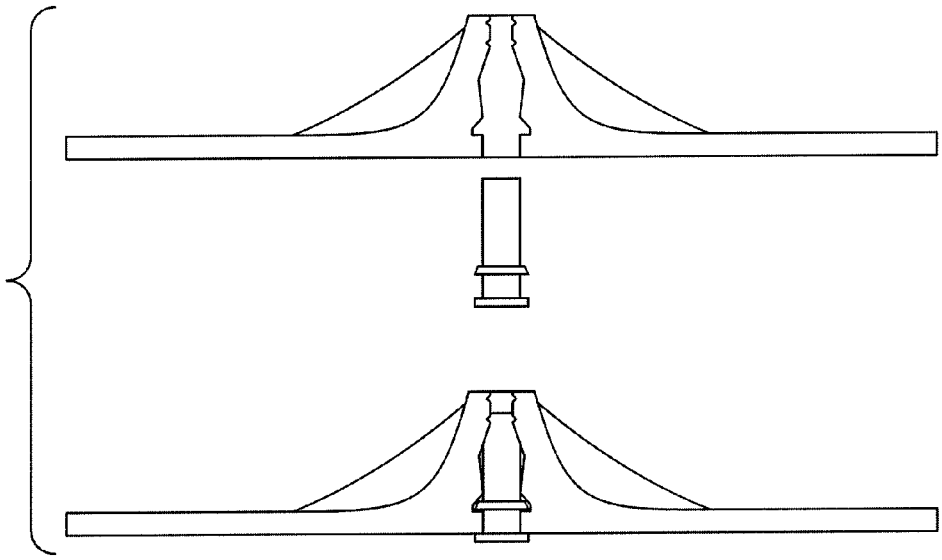
FIG. 1C PRIOR ART
FIG. 1*c* illustrates a prior art method of inserting squeaker into a rough through-hole.

While this invention is illustrated and described in a preferred embodiment, the device may be produced in many different configurations, forms and materials. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Figure 2A:
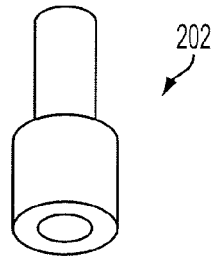
FIG. 2*a* illustrates a typical squeaker mechanism.
Figure 2B:
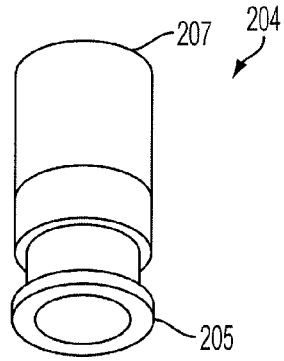
FIG. 2*b* illustrates a rubber sleeve to hold squeaker mechanism.
Figure 2C:
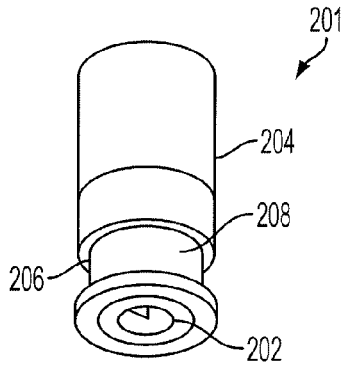
FIG. 2*c* illustrates squeaker mechanism retained in a sleeve and the rubber sleeve including a gluing surface.

FIG. 2*a* shows a typical squeaker mechanism 202. According to a preferred embodiment, FIG. 2*b* shows rubber sleeve 204 with proximate and distal ends 205, 207 respectively. Noise producing element 201 as shown in FIG. 2*c*, is formed by engaging squeaker 202 with sleeve 204 such that squeaker 202 is retained within sleeve 204. The squeaker made from oliphanic material such as polypropylene or polyethylene, is placed into a sleeve that is styrenic and therefore provides a better bonding surface than the squeaker by itself.

Figure 3:
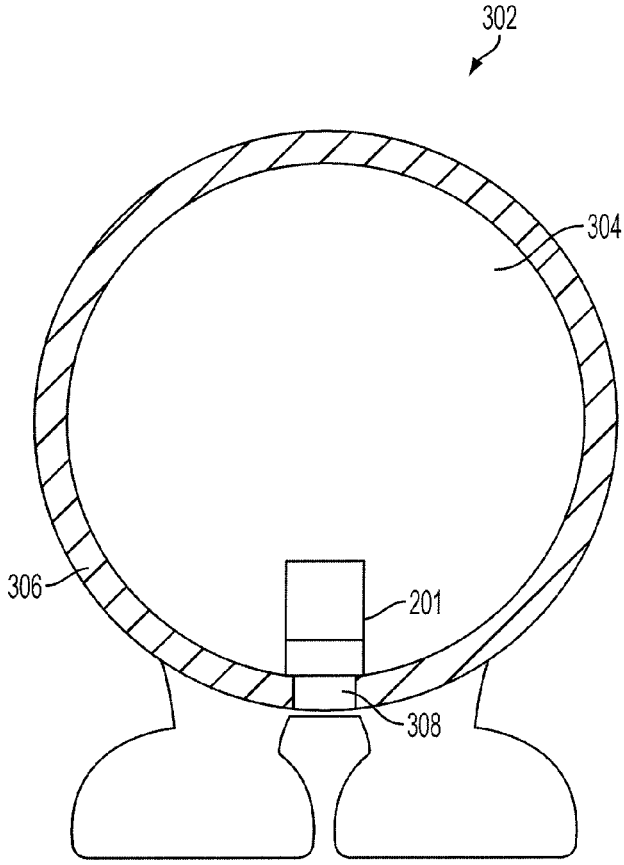
FIG. 3 illustrates mounting arrangement of squeaker in rubber ball.

Referring now to FIG. 3, rubber toy 302 is fashioned of thick-walled heavy-duty rubber. The toy is formed with a hollow body 304 and an outer shell 306. The outer shell is, for example, 2" in diameter. The toy comprises an opening 308 through which the squeaker trapped in a rubber sleeve is inserted. Going back to FIG. 2*c*, the rubber sleeve is utilized as a separate holder for the squeaker and is provided with a bonding surface 208 that aids in the securing of the sleeve to the toy. The sleeve has recessed area 206 that tightly mates with opening 308 in the rubber toy and is bonded to the toy with cyanoacrylate. Please note that functionally equivalent squeaker materials, sleeve materials and bonding agents may be used without departing from the scope of the present invention.

Figure 4A:
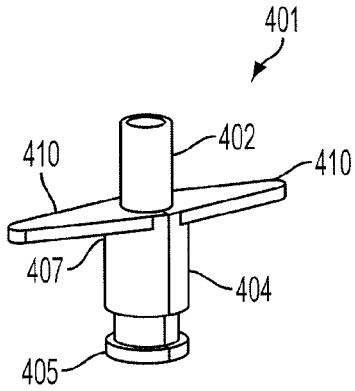
FIG. 4*a* illustrates a squeaker mechanism retained in a polystyrene sleeve.
Figure 4B:
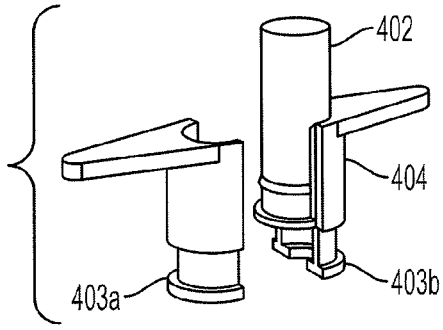
FIG. 4*b* illustrates a sleeve composed of two half shells and extending fins.
Figure 4C:
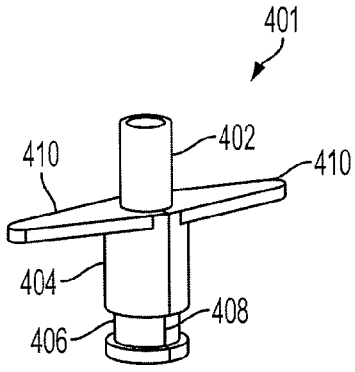
FIG. 4*c* illustrates a sleeve including a gluing surface.

FIGS. 4*a*, 4*b*, 4*c* illustrate a second embodiment of the present invention. FIG. 4*a* shows squeaker 402 retained in polystyrene sleeve 404, with proximate and distal ends 405, 407 respectively, forming noise producing element 401. Sleeve 404 as shown in FIG. 4*b* is composed of two half shells 403*a*, 403*b* to be secured together.

In order to pass the Consumer Product Safety Commission standard for small children, the sleeve size of the present invention must not fall into a 1¼ inch aperture. Therefore to meet the safety ratings, preferably by a ½" diameter, sleeve 404 also includes integral extended members or fins 410 which are orthogonal to squeaker 402 to expand the total width of the sleeve. Please note that fins 410, in an alternative embodiment, may follow the curvature of the inner surface of the small toy.

Figure 5:
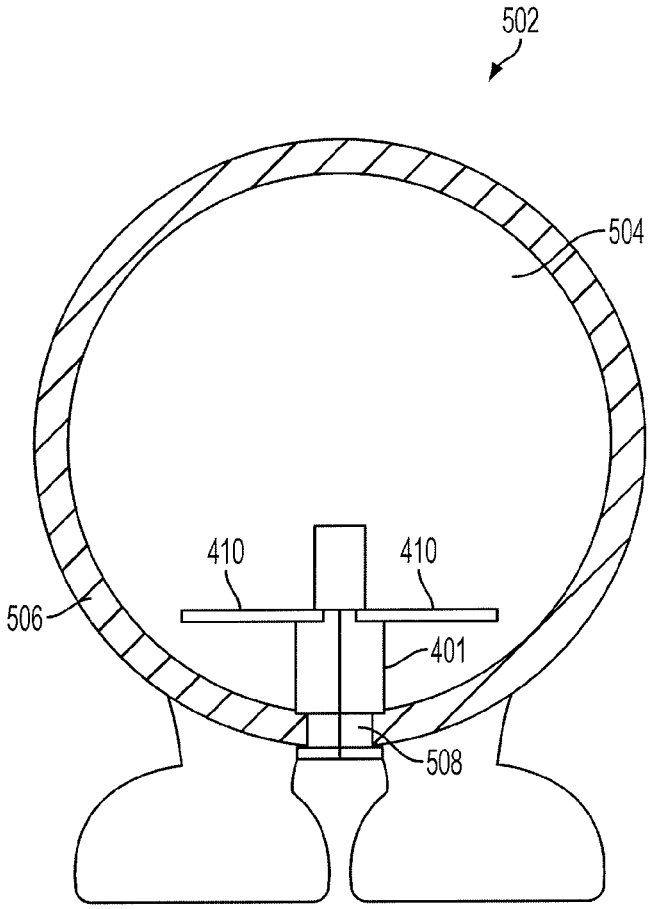
FIG. 5 illustrates mounting arrangement of squeaker in a rubber ball.

Referring to FIG. 5, rubber toy 502 is similar in structure to rubber toy 302 of FIG. 3. The toy is formed with a hollow body 504 and outer shell 506. The outer shell is, for example, 3" in diameter. Sleeve 404 acts as a better bonding surface than squeaker 402. As shown in FIG. 4*c*, recessed area 406 integral to the sleeve mates with an opening 508 in the rubber toy 302. Sleeve 404 including bonding surface 408 secures the sleeve to the rubber toy with cyanoacrylate. Please note that a bigger sized squeaker (with sleeve) could be mounted into a correspondingly bigger toy in a similar manner so as to still provide for the requirements of consumer product safety rating as described above.

As shown in FIG. 5, note that the total width of the sleeve 404 (including the fins 410) is substantially larger than the opening 508 in the rubber toy 302. Thus, it is inherent in the above described structure that even if the cyanoacrylate (or other bonding agent) holding the sleeve 404 to the rubber toy 302 should happen to fail, the sleeve 404 and the squeaker 402 would be retained within the rubber toy 302. That is to say, the sleeve structure that includes the integral fins 410 disclosed in FIG. 5 is inherently adapted to cause the sleeve 404 and the squeaker 402 to fall into the rubber toy 302 (as opposed to falling out of the rubber toy 302) if the bond between the bonding surface 408 of the sleeve 404 separates from the opening 508 in the rubber toy 302.

Figure 6A:
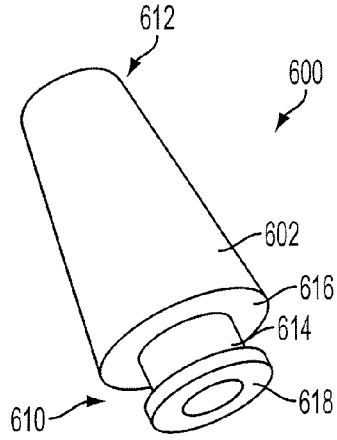
FIG. 6*a* illustrates an isometric view of an additional embodiment of a shroud for protecting a squeaker mechanism.
Figure 6B:
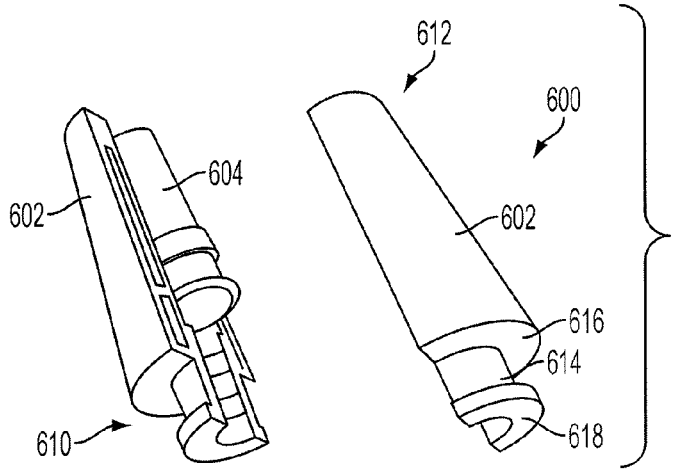
FIG. 6*b* illustrates an open isometric view of the shroud containing a squeaker mechanism of FIG. 6*a;*
Figure 6C:
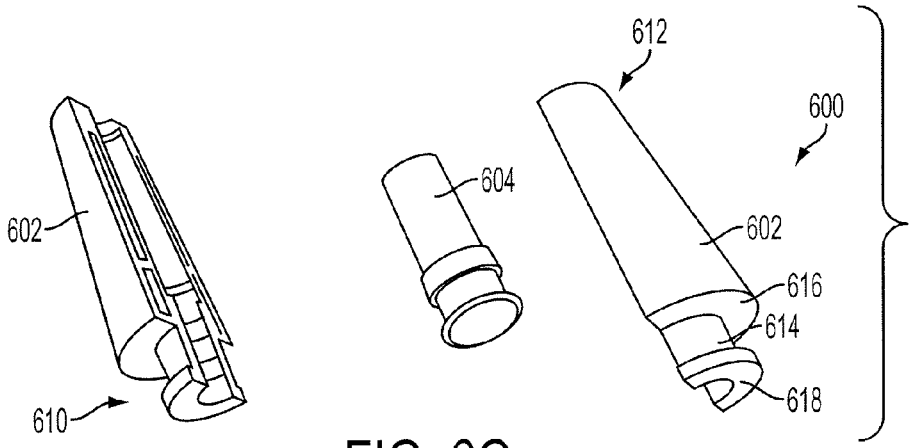
FIG. 6*c* illustrates an exploded isometric view of the shroud containing a squeaker mechanism of FIG. 6*a;*
Figure 6D:
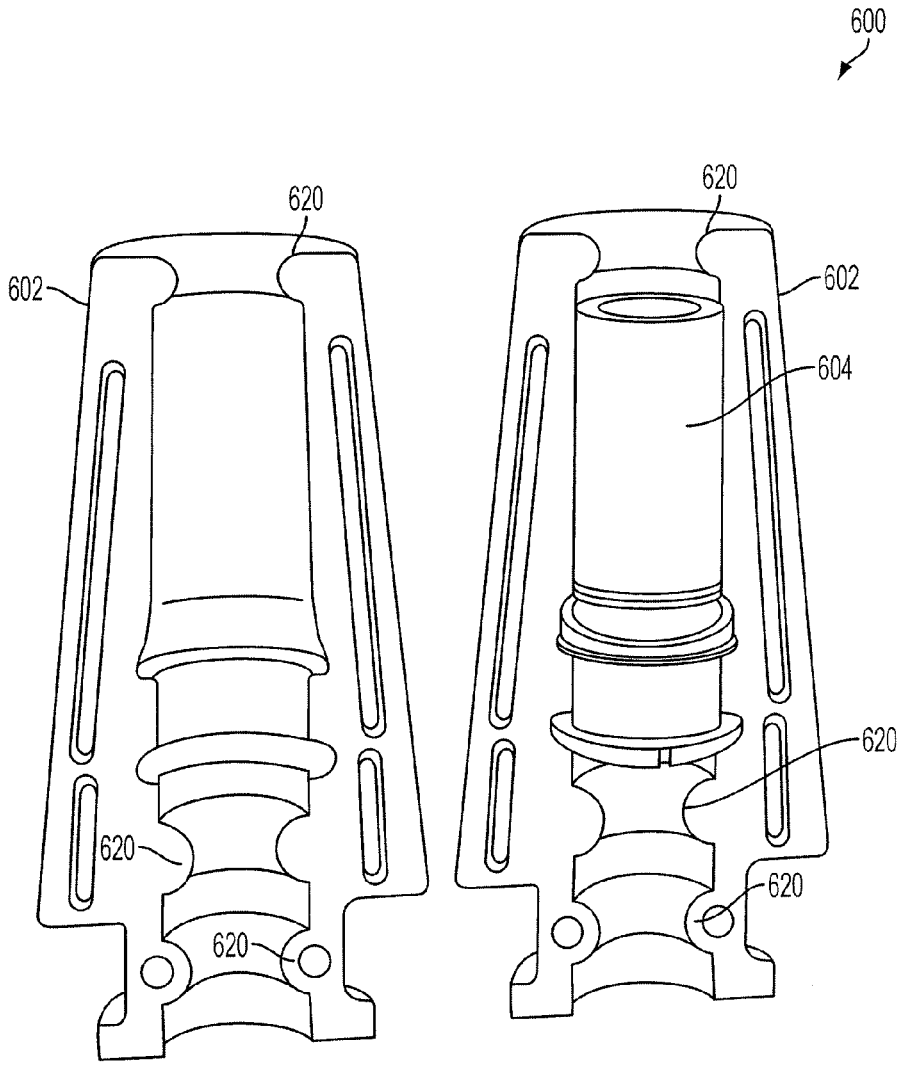
FIG. 6*d* illustrates a close-up open isometric view of the shroud containing a squeaker mechanism of FIG. 6*a;*
Figure 7A:
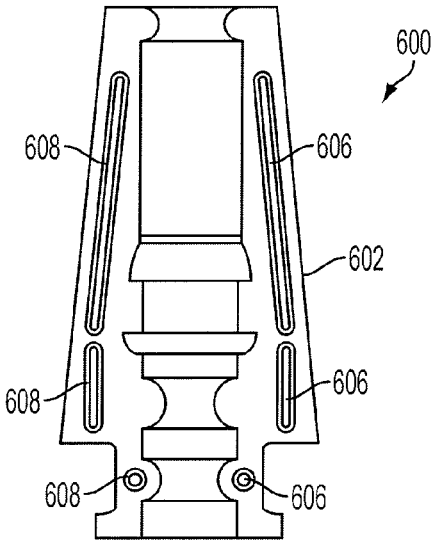
FIG. 7*a* illustrates a front plan view of one half of the sleeve of FIG. 6*a;*
Figure 7B:
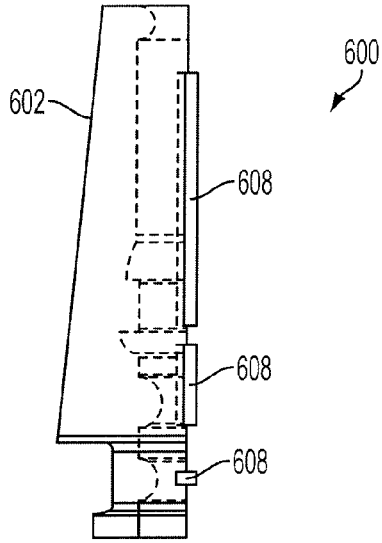
FIG. 7*b* illustrates a side plan view of one half of the sleeve of FIG. 6*a*.
Figure 7C:
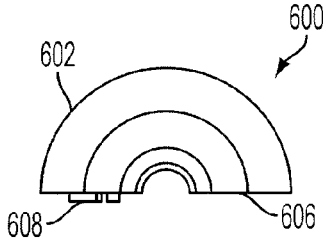
FIG. 7*c* illustrates a top plan view of one half of the sleeve of FIG. 6*a*.

Turning now to FIGS. 6*a* through 6*d* and FIGS. 7*a* through 7*c*, an additional embodiment of the present invention is illustrated. FIG. 6*a* depicts an isometric view of a novel shroud for containing and protecting a squeaker mechanism for use in, e.g., a hollow toy such as a rubber ball or other play device. FIGS. 6*b* through 6*c* depict open, exploded, and close-up open isometric views, respectively, of the shroud containing the squeaker mechanism. FIGS. 7*a* through 7*c* depict front, side, and top plan views of the shroud of FIG. 6*a*.

The embodiment of the present invention that may generally referred to as a noise producing assembly 600 is depicted in FIGS. 6*a*-6*d* and 7*a*-7*c* and may be particularly well adapted to prevent an animal (e.g., a large dog with powerful jaws) from damaging the squeaker mechanism or from biting/chewing out the squeaker mechanism. The depicted noise producing assembly 600 includes a shroud 602 that completely encases a squeaker mechanism 604. The shroud 602 and squeaker mechanism 604 may be made from any practicable material including various plastics, styrenic materials, and those materials described above with respect to the sleeves 204, 404 and squeaker mechanisms 202, 402 of other embodiments. The shroud 602 may be assembled from two identical pieces that may be joined together around the squeaker mechanism 604 as illustrated. In some embodiments, the shroud halves may include cavities 606 that are adapted to receive bosses 608 that serve to align the halves and strengthen the joint. These features may be most clearly seen in FIGS. 7*a* through 7*c*. Note that by having bosses 608 on one side of the shroud half and receiving cavities 606 on the other side of the same shroud half, the same part may be used to manufacture both halves of the shroud 602. The two shroud halves may be joined together using any practicable chemical and/or mechanical bonding method such as methyl ethyl ketone (MEK), cyanoacrylate, other bonding agent, locking pins, snap fasteners, clips, etc., to both lock the squeaker mechanism 604 in place and to protect the squeaker mechanism 604.

Referring to FIG. 6*a*, the shroud 602 and squeaker mechanism 604 may be generally cylindrical. In some embodiments, the shape of the shroud 602 may taper from a wider diameter to a narrower diameter as the shroud 602 extends from a proximate end 610 to a distal end 612. The tapered shape may aid in inserting the noise producing assembly 600 into an opening in a toy (not shown). The proximate end 610 may also include a bonding surface 614 that is adapted to be bonded to the inside of the opening in a toy using any practicable chemical and/or mechanical bonding method such as methyl ethyl ketone (MEK), cyanoacrylate, other bonding agent, locking pins, snap fasteners, clips, etc. The diameter of the shroud 602 at the bonding surface 614 may be sized to precisely fit the opening in the toy.

The shroud 602 may also include an interior flange 616 and an exterior flange 618 at the proximate end 610 that together are adapted to hold the noise producing assembly 600 in the opening of the toy, thereby supporting the bonding method. In some embodiments, the toy may include a countersunk opening (not shown) that is adapted to receive the exterior flange 618 so that the exterior flange 618 sits flush with the outer surface of the toy. The interior flange 616 may have a diameter the size of the widest part of the shroud 602 and be substantially larger than both the exterior flange 618 and the opening in the toy. For example, the diameter of the interior flange 616 may be approximately 1.3 to 5 times larger than the opening in the toy. Other dimensions are possible. The diameter of the exterior flange 618 may be larger than the opening in the toy but smaller than the interior flange 616. This structure insures that even if the bonding method fails, the noise producing assembly 600 can only fall into the toy and cannot exit the toy. Further, even if the opening in the toy is distorted and/or enlarged enough to let the flanges slip through, the noise producing assembly 600 will tend to be more likely to fall into the toy than out of the toy due to the relative sizes of the flanges. Thus, the structure provides an inherent safety feature to the present invention that is operative to prevent an animal from working the noise producing assembly 600 out of the toy through chewing, biting, or otherwise distorting the toy. This safety feature can help prevent choking or other injuries to an animal playing with the toy, because even if the noise producing assembly 600 does become loose, it will remain trapped within the toy.

As indicated above, the squeaker mechanism 604 may be completely contained in the shroud 602. Completely encapsulating the squeaker mechanism 604 in the shroud 602 provides additionally safety features to the present invention. The entire length of the squeaker mechanism 604 may be bonded to the shroud 602 to further prevent removal of the squeaker mechanism 604 from the toy. Referring specifically to FIG. 6*d*, the shroud 602 may also include internal rings 620 that both add structural stability to the noise producing assembly 600 and further secure the squeaker mechanism 604 in the shroud 602 by preventing longitudinal movement of the squeaker mechanism 604 relative to the shroud 602. Each of the internal rings 620 include an opening that is smaller in diameter than the diameter of the squeaker mechanism 604 at the ends of the squeaker mechanism 604. The body of the squeaker mechanism 604 may further include annular protrusions and recesses that mate with corresponding recesses and protrusions in the inner surface of the shroud 602 that also prevent longitudinal movement of the squeaker mechanism 604 relative to the shroud 602. The added structural stability of the internal rings 620 insures that the noise producing assembly 600 cannot be crushed by an animal playing with the toy or by chewing, biting, or otherwise distorting the toy.

CONCLUSION

A system and method has been shown in the above embodiments for the effective implementation of mounting arrangement for squeakers. While various preferred embodiments have been shown and described, it will be understood that there is no intent to limit the invention by such disclosure, but rather, it is intended to cover all modifications and alternate constructions falling within the spirit and scope of the invention, as defined in the appended claims. For example, the present invention should not be limited by size, materials, or specific manufacturing techniques.

What is claimed is:

1. A noise producing toy structure comprising:
at least an outer shell;
an opening in said outer shell to accommodate a noise producing element; and
said noise producing element comprising:
a shroud comprising proximate and distal ends;
means for securing the shroud within said opening;
a squeaker mechanism retained within said shroud, the squeaker mechanism being capable of making a sound by itself when air passes through it,
wherein the shroud is adapted to cause the noise producing element to be retained within the outer shell if the means for securing fails,
wherein the shroud is adapted to prevent an animal from damaging the squeaker mechanism.

2. A noise producing toy structure, according to claim 1, wherein said means for securing includes a bonding agent.

3. A noise producing toy structure, according to claim 2, wherein said bonding agent includes methyl ethyl ketone.

4. A noise producing toy structure, according to claim 1, wherein said shroud has a tapered shape that expands from the distal end to the proximate end.

5. A noise producing toy structure, according to claim 4, wherein the shroud includes an interior flange and an exterior flange.

6. A noise producing toy structure, according to claim 5, wherein the exterior flange prevents the noise producing element from being removed from the outer shell.

7. A noise producing toy structure, according to claim 4, wherein the tapered shape causes the noise producing element to become trapped within the outer shell if the means for securing fails.

8. A noise producing toy structure comprising:
at least an outer shell;
an opening in said outer shell to accommodate a noise producing element; and
said noise producing element comprising:
a shroud comprising proximate and distal ends;
means for securing the shroud within said opening;
a squeaker retained within said shroud,
wherein the shroud is adapted to cause the noise producing element to be retained within the outer shell if the means for securing fails
wherein said shroud has a tapered shape that expands from the distal end to the proximate end;
wherein the shroud includes an interior flange and an exterior flange; and
wherein a diameter of the interior flange is larger than a diameter of the exterior flange.

9. A noise producing toy structure, according to claim 8, wherein relative sizes of the flanges cause the noise producing element to be retained within the outer shell if the means for securing fails.

10. A method of mounting a squeaker in a toy, said method comprising:
encapsulating a squeaker mechanism into a shroud, the squeaker mechanism being capable of making a sound by itself when air passes through it;
mating said encapsulated shroud and squeaker with an opening in said toy; and
bonding said shroud to said toy,
wherein the shroud is adapted to be retained within the toy if the bonding fails, and
wherein the shroud is adapted to prevent an animal from damaging the squeaker mechanism.

11. A method of mounting a squeaker in a toy, according to claim 10, wherein said shroud is bonded with methyl ethyl ketone.

12. A method of mounting a squeaker in a toy, according to claim 10, wherein adapting the shroud to be retained within the toy includes shaping the shroud to include an expanding diameter along a length of the shroud such that a diameter of the shroud within the toy at a proximate end of the shroud is larger than the opening in the toy.

13. A method of mounting a squeaker in a toy, said method comprising:
encapsulating a squeaker into a shroud;
mating said encapsulated shroud and squeaker with an opening in said toy; and
bonding said shroud to said toy,
wherein the shroud is adapted to be retained within the toy if the bonding fails
wherein adapting the shroud to be retained within the toy includes shaping the shroud to include an expanding diameter along a length of the shroud such that a diameter of the shroud within the toy at a proximate end of the shroud is larger than the opening in the toy;
further comprising providing an external flange at the proximate end of the shroud that has a diameter that is:
smaller than the diameter of the shroud within the toy at a proximate end of the shroud, and
larger than the opening in the toy.

14. A noise producing mechanism retained in a hollow body comprising:
a shroud including a proximate end, a distal end, and generally having a tapered cylindrical shape with a smaller diameter at the distal end than at the proximate end, wherein the shroud is secured within an opening in said hollow body; and
a squeaker mechanism retained within said shroud, the squeaker mechanism being capable of making a sound by itself when air passes through it, wherein a diameter of the shroud at the proximate end disposed within the hollow body is sufficient to retain the noise producing mechanism within the hollow body if the shroud becomes unsecured from the opening in the hollow body, wherein the shroud is adapted to prevent an animal from damaging the squeaker mechanism.

15. A noise producing mechanism retained in a hollow body, according to claim 14, wherein said shroud includes a flange extending from the proximate end of said shroud and disposed external to the hollow body.

16. A noise producing mechanism retained in a hollow body, according to claim 14, wherein said shroud is made of styrenic material.

17. A noise producing mechanism retained in a hollow body, according to claim 14, wherein said hollow body is a rubber ball.

18. A noise producing mechanism retained in a hollow body, according to claim 14, wherein said hollow body is a rubber squeeze Figure toy.

19. A noise producing mechanism retained in a hollow body, according to claim 14, wherein said hollow body is a pet toy.

20. A noise producing mechanism retained in a hollow body comprising:

a shroud including a proximate end, a distal end, and generally having a tapered cylindrical shape with a smaller diameter at the distal end than at the proximate end, wherein the shroud is secured within an opening in said hollow body; and a squeaker retained within said shroud, wherein a diameter of the shroud at the proximate end disposed within the hollow body is sufficient to retain the noise producing mechanism within the hollow body if the shroud becomes unsecured from the opening in the hollow body;

wherein said shroud includes a flange extending from the proximate end of said shroud and disposed external to the hollow body;

wherein said flange has a diameter that is smaller than the diameter of the shroud at the proximate end disposed within the hollow body and larger than the opening in the hollow body.

* * * * *